US011661267B2

(12) United States Patent
Kelders

(10) Patent No.: US 11,661,267 B2
(45) Date of Patent: May 30, 2023

(54) DISPENSER CONTAINER, DISPENSER AND METHOD FOR MANUFACTURING A DISPENSER CONTAINER

(71) Applicant: ALUAIR GMBH, Baar (CH)

(72) Inventor: Johannes Hubertus Jozef Maria Kelders, Baar (CH)

(73) Assignee: ALUAIR GMBH, Baar (CH)

( * ) Notice: Subject to any disclaimer, the term of this patent is extended or adjusted under 35 U.S.C. 154(b) by 0 days.

(21) Appl. No.: 17/296,094

(22) PCT Filed: Dec. 11, 2018

(86) PCT No.: PCT/EP2018/084409
§ 371 (c)(1),
(2) Date: May 21, 2021

(87) PCT Pub. No.: WO2020/104046
PCT Pub. Date: May 28, 2020

(65) Prior Publication Data

US 2022/0009702 A1 Jan. 13, 2022

(30) Foreign Application Priority Data

Nov. 23, 2018 (WO) ..... PCT/EP2018/082416

(51) Int. Cl.
*B65D 83/66* (2006.01)
*B21D 51/18* (2006.01)

(52) U.S. Cl.
CPC ..... *B65D 83/663* (2013.01); *B21D 51/18* (2013.01)

(58) Field of Classification Search
CPC ..... B65D 83/64; B65D 83/663
(Continued)

(56) References Cited

U.S. PATENT DOCUMENTS 3,216,463 A * 11/1965 Kibbel, Jr. ..... B65D 83/64 141/3
3,273,762 A * 9/1966 O'Neill, Jr. ..... B65D 83/64 222/389

(Continued)

FOREIGN PATENT DOCUMENTS

EP 1725476 B1 10/2007
EP 1594766 B1 8/2009

(Continued)

*Primary Examiner* — Paul R Durand
*Assistant Examiner* — Michael J. Melaragno
(74) *Attorney, Agent, or Firm* — Nath, Goldberg & Meyer; Joshua B. Goldberg

(57) ABSTRACT

The invention relates to a dispenser container for pressurized fluids, comprising: a metal shell forming at least part of an outer wall of the container, which metal shell at least partly encloses an internal container volume, a partition wall separating internal container volume into a high-pressure chamber and a low-pressure chamber, and a valve mounted into the partition wall in a substantially fluid-tight manner, which valve is configured for a controlled release of fluid from the high-pressure chamber to the low-pressure chamber, wherein the partition wall is at a sealing zone sealed to the metal shell in a substantially fluid-tight manner, and wherein the metal shell delimits at least a part of the high pressure chamber. The invention further relates to a dispenser comprising such a dispenser container and a method for manufacturing such a dispenser container.

16 Claims, 5 Drawing Sheets

Figure 1:
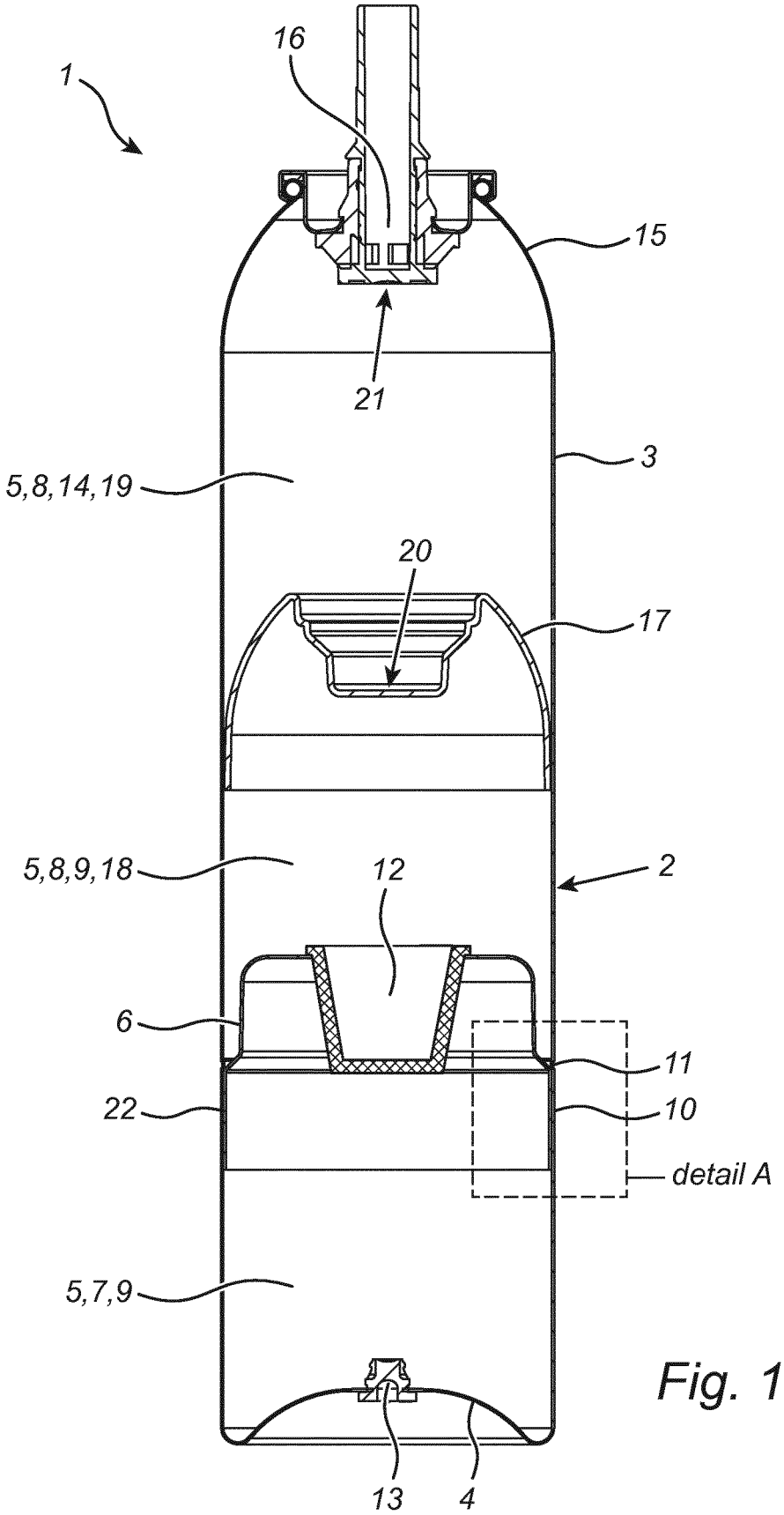

(58) Field of Classification Search
USPC ..... 222/389, 145.5
See application file for complete search history.

(56) References Cited

U.S. PATENT DOCUMENTS

| | | | | | |
|---|---|---|---|---|---|
| 3,362,589 | A * | 1/1968 | Kinnavy | B65D 83/64 | 92/243 |
| 3,407,974 | A * | 10/1968 | Chmielowiec | B65D 83/62 | 222/386.5 |
| 3,827,607 | A * | 8/1974 | Schultz | B65D 83/64 | 222/389 |
| 3,915,352 | A * | 10/1975 | Scheindel | B65D 83/64 | 92/242 |
| 4,023,717 | A * | 5/1977 | Schultz | B65D 83/64 | 222/386.5 |
| 4,045,938 | A * | 9/1977 | Hansen | B65D 83/64 | 53/470 |
| 4,685,597 | A * | 8/1987 | Hirao | B65D 83/64 | 222/387 |
| 4,703,875 | A * | 11/1987 | Malek | B65D 83/64 | 92/248 |
| 4,844,301 | A * | 7/1989 | Juillet | B65D 83/207 | 222/509 |
| 4,913,323 | A * | 4/1990 | Scheindel | B65D 83/64 | 222/386 |
| 5,065,900 | A * | 11/1991 | Scheindel | B65D 83/64 | 222/386 |
| 5,419,466 | A * | 5/1995 | Scheindel | B65D 83/64 | 222/402.1 |
| 5,441,181 | A * | 8/1995 | Scheindel | B65D 83/64 | 222/386 |
| 5,522,526 | A * | 6/1996 | DeLaforcade | B65D 83/62 | 222/387 |
| 5,573,137 | A * | 11/1996 | Pauls | B65D 83/64 | 222/196 |
| 5,775,549 | A * | 7/1998 | de Laforcade | B65D 83/64 | 222/389 |
| 6,230,943 | B1 * | 5/2001 | Miyamoto | B65D 83/646 | 222/402.1 |
| 6,244,475 | B1 * | 6/2001 | Walz | B65D 83/38 | 222/387 |
| 6,325,254 | B1 * | 12/2001 | Diamond | B65D 83/64 | 222/386 |
| 6,880,732 | B2 * | 4/2005 | Scheindel | B65D 83/64 | 222/386 |
| 8,245,888 | B2 * | 8/2012 | Andersen | B65D 83/64 | 222/386 |
| 2003/0019888 | A1 * | 1/2003 | Gupta | B65D 83/64 | 222/389 |
| 2009/0283550 | A1 * | 11/2009 | Kimball | B65D 83/64 | 222/387 |
| 2014/0131395 | A1 * | 5/2014 | Chang | A61K 8/70 | 222/394 |
| 2021/0101738 | A1 * | 4/2021 | Vanderstraeten | B65D 83/663 | |

FOREIGN PATENT DOCUMENTS

| | | | | | |
|---|---|---|---|---|---|
| EP | 2925635 | B1 | 6/2018 | | |
| GB | 602325 | A | 5/1948 | | |
| WO | 2006/024891 | A1 | 3/2006 | | |
| WO | 2014/083531 | A2 | 6/2014 | | |
| WO | WO-2015008250 | A2 * | 1/2015 | B65D 83/20 | |
| WO | 2016/120269 | A1 | 8/2016 | | |
| WO | 2016/120404 | A1 | 8/2016 | | |
| WO | WO-2016120404 | A1 * | 8/2016 | B29C 45/14 | |
| WO | 2017/064621 | A1 | 4/2017 | | |
| WO | WO-2017080685 | A1 * | 5/2017 | | |
| WO | 2018185652 | A1 | 10/2018 | | |
| WO | WO-2018185652 | A1 * | 10/2018 | B65D 83/64 | |
| WO | WO-2022018205 | A1 * | 1/2022 | B65D 83/42 | |

* cited by examiner

DISPENSER CONTAINER, DISPENSER AND METHOD FOR MANUFACTURING A DISPENSER CONTAINER

This is a National Phase Application filed under 35 U.S.C. 371 as a national stage of PCT/EP2018/084409, filed Dec. 11, 2018, an application claiming the benefit of International Application No. PCT/EP2018/082416, filed Nov. 23, 2018, the content of each of which is hereby incorporated by reference in its entirety.

The invention relates to a dispenser container comprising a metal shell forming at least part of an outer wall of the container, which metal shell at least partly encloses an internal container volume comprising a high-pressure and a low-pressure chamber. The invention further relates to a dispenser comprising such a dispenser container and a method for manufacturing such a dispenser container.

Containers for pressurized dispensers fulfil multiple functions, including containing a fluid to be dispensed, and maintaining an overpressure inside the container for dispensing of the fluid contained inside the container. A well-known problem with common dispensers is that the pressure at which the fluid to be dispensed is contained, changes over time, due to the leakage of propellant from the container as well as the deceasing level of the fluid to be dispensed as a result of normal use of the dispenser. Although in common household applications, such a variation in pressure may be acceptable, other applications including the dispensing of high viscous substances such as sealants or caulks, or applications in a medical context, require accurate dosing control.

To guarantee a constant and predictable outflow of fluid over the lifetime of the dispenser, the pressure prevailing in fluid to be dispensed should thus be kept constant. More advanced dispenser containers are therefore pressure controlled, for which they are provided with a canister containing a highly pressurized propellant. The canister is furthermore provided with a pressure control valve that controls the outflow of propellant from the canister based on the pressure prevailing in the fluid to be dispensed, thereby keeping the fluid to be dispensed at a constant pressure. A drawback related to the use of these pressure controlled dispensers is that the integration of the high-pressure canisters significantly increases the complexity of the dispensers. This increased complexity of the final product leads to a longer and more complex manufacturing process and an accompanying increase in production costs.

It is therefore an object of the present invention to provide a pressure controlled dispenser container that can be produced in a less complex and more cost-effective manner.

The present invention thereto proposes a dispenser container for pressurized fluids, comprising: a metal shell forming at least part of an outer wall of the container, which metal shell at least partly encloses an internal container volume, a partition wall separating internal container volume into a high-pressure chamber and a low-pressure chamber, and a valve mounted into the partition wall in a substantially fluid-tight manner, which valve is configured for a controlled release of fluid from the high-pressure chamber to the low-pressure chamber, wherein the partition wall is at a sealing zone sealed to the metal shell in a substantially fluid-tight manner, and wherein the metal shell delimits at least a part of the high pressure chamber.

The metal shell may be made of any suitable metal, including aluminium, steel and tin plate. The partition wall may likely be made from a metal such as aluminium, steel and tin plate. It is hereby advantageous if the material of the partition wall corresponds to the material of the metal shell, as the use of a single material may decrease the manufacturing complexity and costs. The choice of material for the partition wall may however include any suitable material, not necessarily being metal. For example, the partition wall may be made from a plastic, such as polyethylene terephthalate (PET), or a combination of plastics. It is moreover possible that the partition wall is made from a composite material, comprising a combination of different types of materials. In addition, the partition wall may comprise several layers of the same or different materials that together form a laminate.

The use of a metal shell as (a part of) the outer wall of the container provides the dispenser container according to the present invention with a number of benefits. First of all, as the metal shell produces a high-strength container wall, the inherent strength of metal shell may be utilized for resisting against an over-pressure prevailing in the internal container volume. As the metal shell delimits at least a part of the high pressure chamber, the metal shell specifically resists against the pressure difference between the high-pressure chamber and the outside environment. A highly pressurized propellant commonly present inside the high-pressure chamber is hereby contained by the metal shell and thus the outer wall of the container. This foregoes the necessity of using a separate canister (fully) enclosing the high-pressure chamber. The high strength (relative to e.g. plastics) of the metal shell moreover allows it to contain propellants under increased pressures, facilitating the design of smaller dispenser containers or dispenser containers containing increased volumes of dispensable fluid.

Another advantage related to the use of a metal shell is that, compared to plastics, metal generally has a low permeability to propellant gasses and fluids contained within the dispenser container as well as moisture to which the outside of the metal shell is exposed. As a further advantage, metal offers a superior protection against UV-radiation compared to plastics. Both these aspects add up providing the dispenser according to the present invention provided with a metal shelf with a longer shelf life compared to plastic dispenser counterparts. Moreover metals are resistant to the corrosive action of various chemicals where plastics might not be, allowing the metal shell dispenser container to contain different types of dispensable fluids than its plastics counterparts. Yet another advantage that is brought about by the use of a metal shell is that metals allow for high tolerance production. The ability to keep the variations in physical dimensions of the metal shell to a minimum is very important for seal quality, and in particular for obtaining a high-quality and fluid-tight seal between the metal shell and the partition wall.

The sealing of the partition wall to the metal shell may be accomplished by any suitable sealing or bonding technique, including welding, soldering, fusing, or gluing. Typically, the partition wall hereby connects to the metal shell in a form-fitting manner, meaning that the partition wall follows the contours of the metal shell over at least the part where the partition wall connects to the metal shell. The form-fitting connection between the partition wall and the metal shell hereby aids in obtaining a fluid-tight seal. The seal created between the partition wall and the metal shell should typically be fluid tight to at least $8 \cdot 10^5$ Pa, preferably to at least $10 \cdot 10^5$ Pa, and more preferably to at least $15 \cdot 10^5$ Pa. Alternatively or additionally, the seal may comprise a mechanical in the form of a gasket, such as an O-ring, which gasket may be positioned in between the partition wall and the metal shell. The partition wall may by for example the above-mentioned bonding techniques moreover be fixedly connected to the metal shell such that the partition wall is unable to move relative to the metal shell and the volume of the low-pressure chamber respectively the high-pressure chamber remains constant.

It is possible that the internal wall of the metal shell and/or the surface of the partition wall interfacing the internal wall of the metal shell are provided with a sealing material to create a fluid-tight seal at the sealing zone between the partition wall and the metal shell. The sealing material is hereto commonly (partly) heated and/or melted to bond the partition wall to the metal shell. Sealing materials suitable for this purpose include thermoplastic polymers, in particular thermoplastic elastomers, or polyolefins including (but not being limited to) polyethylene (PE), polypropylene (PP), polymethylpentene (PMP) and polybutylene (PB). Alternative sealing materials comprise natural and synthetic rubbers, including nitrile butadiene rubber (NBR). It is also possible that the internal wall of the metal shell and/or the surface of the partition wall interfacing the internal wall of the metal shell are provided with a coating for the reason of creating a fluid-tight or non-reactive barrier between the metal shell and/or the partition wall on the one hand and the fluid(s) contained within the internal container volume on the other hand. In this case, the coating may aid in the sealing of the partition wall to the metal shell, which may be accomplished by (partly) melting the coating on the internal wall of the metal shell and/or the surface of the partition wall interfacing the metal shell to create a fluid-tight bond between the partition wall and the metal shell.

Advantageously, the metal shell may further delimit at least a part of the low pressure chamber such that the metal shell itself functions to contain the fluid inside the low-pressure chamber. The use of a separate container for (fully) enclosing the low-pressure chamber and containing the fluid inside the low-pressure chamber is in this case not necessary.

An outer side of the metal shell may be provided with at least one indent extending into the internal container volume, wherein the at least one indent forms at least part of the sealing zone. Said indent may hereby act as an abutment or indexing surface for the partition wall, such that the partition wall is automatically placed in the correct position inside the metal shell. The partition wall may either directly or indirectly contact said indent, wherein in the latter case, the partition wall contacts the indent with the interposition of one or more additional material layers such as a sealing material layer. The indent may moreover act to increase the surface area of the sealing zone over which the partition wall connects to the metal shell, which benefits the quality and strength of the seal. For the same reason of increasing the bonding area between the metal shell and the partition wall, the at least one indent may extend at least partly along, and preferably fully around a circumference of the outer wall of the container. The partition wall may additionally be provided with a further indent cooperating with the indent provided in the metal shell. The indents in the metal shell and partition wall may hereby together form a (self-seeking) snap-fit joint to further guarantee a correct placement of the partition wall inside the metal shell. In a possible embodiment, the at least one indent may extend into the low-pressure chamber to form an abutment surface for a part of a surface of the partition wall adjoining the low-pressure chamber. As the indent is positioned at the low-pressure side of the partition wall, the pressure difference between the high-pressure chamber and the low-pressure chamber causes the partition wall to be pressed against the indent, which partition wall is then automatically retained inside the metal shell at the intended position. Again, the contact or the abutting of the partition wall against the indent should hereby be understood to be either directly or indirectly with the interposition of one or more additional material layers.

The partition wall may have an at least partly convex shape, extending at least partly past the sealing zone into the low-pressure chamber. Alternatively, the partition wall may have an at least partly concave shape, extending at least partly past the sealing zone into the high-pressure chamber. Specifically, the partition wall may in either case be (partly) dome-shaped, wherein the partition wall projects radially inwards in a gradual fashion. The convex or concave shape may hereby aid in reducing the internal loads in the partition wall as a result of the forces being exerted thereon due to the pressure difference existing over the opposing sides of the partition wall.

The partition wall may comprise a rim portion extending in a direction parallel to the metal shell, wherein at least part of the rim portion forms part of the sealing zone. Said rim portion may be used to increase the surface over which the sealing zone extends along the partition wall and therewith along the metal shell. This benefits the quality of the seal, as well as the strength of the bond between the partition wall and the metal shell.

In a typical embodiment of the dispenser container according to the invention, the metal shell comprises a side wall and a bottom. The side wall and the bottom may hereby form a single, integral part of the metal shell, which may for instance be the result of a deep drawing process wherein a punch is driven into a blank to form the metal shell. Alternatively, the metal shell may comprise a seamed side wall and a separate bottom, connected to the side wall. Said seemed side wall may be the product of a metal sheet transformed into a tubular side wall wherein two adjacent edges of the metal sheet are connected with a seam. The tubular side wall commonly takes a cylindrical shape, which is best able to resist against internal pressure. In case that a seemed side wall is used, the bottom may be made out of any suitable metal, not necessarily similar to the material of the tubular side wall.

In another embodiment of the dispenser container according to the invention, the valve mounted into the partition wall may be a constant pressure release valve, configured for releasing fluid from the high pressure chamber to the low pressure chamber at a constant pressure. In other words: the constant pressure release valve is configured for regulating the pressure difference between the high pressure chamber and the low pressure chamber to ensure a constant pressure inside the low-pressure chamber, independent of the pressure inside the high-pressure chamber, given that the pressure in the high-pressure chamber exceeds the pressure in the low-pressure chamber.

The valve may, in addition to being configured for a controlled release of fluid from the high-pressure chamber to the low-pressure chamber, be configured as a filling valve allowing the pass-through of a fluid to the high-pressure chamber. This allows the high-pressure chamber to be filled with a propellant without the need for an additional filling valve. Alternatively, the metal shell may be provided with a dedicated filling valve connecting to the high-pressure chamber. Said dedicated filling valve hereby does not function as a pressure regulating valve but only functions as a one-way valve allowing the pass-through of a propellant towards the high-pressure chamber. In a typical instance, the dedicated filling valve is provided in the bottom of the dispenser, opposing a dispensable fluid fill opening typically present at a top end of the dispenser container. The a dedicated filling valve allows the dispenser to be filled with propellant in a finished state of the dispenser container, even after filling of the container with the fluid to be dispensed.

Commonly, the dispenser container comprises an outlet valve connecting the low-pressure chamber with an outside of the dispenser container. Said outlet valve may be positioned at a top end of the dispenser container opposite to the bottom of the dispenser container. The top end is hereto typically provided with a neck portion engaged by the outlet valve. The connection between the outlet valve and said neck portion may hereby be accomplished through thread provided on the neck portion and the outlet valve. As the top end of the dispenser container commonly functions as a fill opening for filling the dispenser container with a dispensable fluid, the outlet valve is commonly placed on top of the dispenser container after filling the dispenser container with the fluid to be dispensed. Following the placement of the outlet valve onto the dispenser container, additionally a dispensing head may be placed over the outlet valve. Said dispensing head is hereby typically used to control the operation of the outlet valve as well as to further control the outflow of the dispensable fluid.

In yet another embodiment of the dispenser container according to the invention, the dispenser container may comprise a piston moveably positioned in the low-pressure chamber, wherein the piston separates the low-pressure chamber into a first compartment extending between the partition wall and the piston, and a second compartment bordering a side of the piston facing away from the first compartment. The piston may be configured for a substantially fluid-tight separation between the first and second compartment, which is especially important in the case the dispensable fluid has a low viscosity. For fluid-tight connection with dispenser container wall, the piston typically abuts the internal wall of the metal shell. Specifically, the piston may hereby engage the internal wall of the metal shell under pretension, for which the piston may be made from a flexible material, such as high-density polyethylene (HDPE). The second compartment commonly extends between the piston and the top end of the dispenser container, such that the second compartment connects to the outlet valve once the outlet valve is placed on said top end of the dispenser container. The first compartment typically contains a propellant under low-pressure, being a pressure smaller than the pressure prevalent in the high-pressure chamber but a pressure higher than the environmental (outside) pressure. The second compartment typically contains a fluid to be dispensed, in which fluid the prevailing pressure is approximately similar to the pressure in the first compartment. Such a separation of the (low-pressure) propellant and the dispensable fluid is particularly useful in case the fluid to be dispensed has a high viscosity. The piston hereby guarantees a proper dispensing of the dispensable fluid.

It in a bottommost position of the piston wherein the piston at least partly abuts the partition wall, a space may left between the piston and the partition wall. This space functions as a buffer volume that contributes to the stability and proper functioning of the valve such that a controlled release of fluid from the high-pressure chamber to the low-pressure chamber takes place in case fluid is dispensed from the second compartment. For this purpose, said space preferably has a volume of at least 4 ml.

A surface of the piston facing the second compartment (and therewith facing the outlet valve) may have a shape at least partly corresponding to the contours of bottom end of the outlet valve facing the piston. In case the piston is moved into a fully upward position wherein the piston abuts an inner surface of the top end of the dispenser container, the shape of the piston at least partly corresponding to the contours of bottom end of the outlet valve allows the piston to lie flat against the outlet valve, leaving substantially no space between the piston and the outlet valve. The volume of the second compartment is hereby reduced to about zero, ensuring that the dispenser is fully emptied, leaving (virtually) no residual dispensable fluid inside the dispenser.

In a different embodiment of the dispenser container, the dispenser container may further comprise a dip tube connected to the outlet valve and extending into the low-pressure chamber. Under the influence of the pressurized propellant present in the low-pressure chamber, the dispensable liquid is forced through the dip tube and out of the outlet valve. As the propellant generally has a lower density than the dispensable fluid, the propellant will sit on top of the dispensable fluid. The dip-tube therefore has to extend below the propellant level and into the dispensable fluid, for which the dip tube typically extends up to the partition wall.

The invention also relates to a dispenser comprising a dispenser container according to the invention, wherein the high-pressure chamber contains a propellant and in that the low pressure chamber comprises a fluid to be dispensed. Filling of the dispenser container with the propellant and the fluid to be dispensed is typically performed after assembling the dispenser container. It is also possible that the high-pressure chamber is sealed off from the environment in a pressure chamber containing pressurized propellant. The propellant is hereby enclosed inside the high-pressure chamber during assembly, such that a separate filling step is foregone and no propellant filling valve needs to be incorporated into the dispenser container. The top end of the dispenser container commonly functions as a fill opening for filling the dispenser container with a dispensable fluid, and is therefore left open till after the dispenser container is filled with said dispensable fluid. Any outlet valve is then placed on top of the dispenser container after filling the dispenser container with the fluid to be dispensed.

The invention further relates to a method for manufacturing a dispenser container according to any of the claims, comprising the steps of: A) forming the metal shell, B) mounting the valve into the partition wall, C) positioning the partition wall into the internal container volume at least partly enclosed by the metal shell, and D) sealing the partition wall to the metal shell. Step A) may hereby comprise deep drawing a blank (slug) wherein a punch is driven into the blank, thus forming a single, integral part comprising a bottom and a side wall of the metal shell. Alternatively, step A) may comprise transforming a metal sheet into a tubular side wall wherein two adjacent edges of the metal sheet are connected with a seam, and subsequently connecting a separate bottom to a bottom end of the tubular side wall.

The mounting of the valve into the partition wall may involve gluing or (laser) welding the valve onto the partition wall. As an alternative way of fastening the valve onto the partition wall, at least a top part of the valve may be placed against a surface of the partition wall facing the high-pressure chamber, such that the valve is pressed against the partition wall under the influence of the overpressure in the high-pressure chamber, thereby creating a seal between the partition wall and the valve. To increase the seal quality the partition wall surface facing the high pressure chamber may form-fit the (top end of the) valve.

The partition wall is commonly sealed to the metal shell by means of at least one of a welded bond, a soldered bond, an adhesive bond, a fusion bond, a friction bond and a gasket. Specifically, the partition wall may be sealed to the metal shell by at least partly melting a sealing material provided at the sealing zone between the metal shell and the partition wall. The sealing material may hereto be provided on an internal surface of the metal shell and/or a surface of the partition wall interfacing the metal shell prior to positioning the partition wall into the internal container volume. The sealing material may, prior to positioning the partition wall into the internal container volume, in particular be applied onto the partition wall, preferably in the form of a ring being pre-assembled around at least a part of a rim portion of the partition wall. In the specific case that the internal wall of the metal shell and/or the surface of the partition wall interfacing the internal wall of the metal shell are provided with a coating, said coating may also function as a sealing material. A fluid-tight bond between the partition wall and the metal shell is then established by (partly) melting said coating applied on the internal wall of the metal shell and/or the surface of the partition wall interfacing the metal shell.

The sealing process may involve locally heating the metal shell and/or the partition wall at the sealing zone. During this heating, any sealing material present between the partition wall and the metal shell may hereby be melted (partly). The local heating of the metal shell and/or the partition wall at the sealing zone may be performed through electromagnetic induction, as induction allows for a fast, uniform and targeted heating of the sealing zone. It is however also possible that the local heating is performed by means of one or more lasers, that may target the entire sealing zone by means of a rotation of the dispenser container or through the use of one or more reflectors. After sealing of the partition wall to the metal shell, the sealing zone may be actively cooled to increase the sealing quality and/or allow for rapid further processing of the dispenser container. Active cooling in this means that the dispenser container is submitted to a cooling process, opposed to allowing the dispenser container to cool off passively under the influence of normal ambient temperatures.

After positioning the partition wall into the internal container volume the metal shell may be provided with at least one indent extending into the internal container volume, followed by applying a pressure difference over the partition wall such that the partition wall is pressed against the at least one indent. The indent hereby acts as an indexing surface that guarantees placement of the partition wall in its intended position within the metal shell. In a specific instance, the at least one indent may extend into the internal container volume at a side of the partition wall adjoining the low-pressure chamber and the partition wall may be pressed against the indent with a part of a surface of the partition wall adjoining the low-pressure chamber as a result of the applied pressure difference, wherein the pressure at a side of the partition wall adjoining the high-pressure chamber exceeds the pressure at the side of the partition wall adjoining the low-pressure chamber. To create said pressure difference, an overpressure may be applied to the high-pressure chamber or an underpressure may be applied to the low-pressure chamber.

After sealing the partition wall to the metal shell, a top end of the metal shell opposing a bottom of the metal shell may be formed into a neck portion configured for connection with an outlet valve. The connection between the outlet valve and said neck portion may hereby be accomplished by providing a thread on the neck portion and the outlet valve. As the top end of the dispenser container commonly functions as a fill opening for filling the dispenser container with a dispensable fluid, the outlet valve is commonly placed (screwed) on top of the dispenser container after filling the dispenser container with the fluid to be dispensed.

Figure 2:
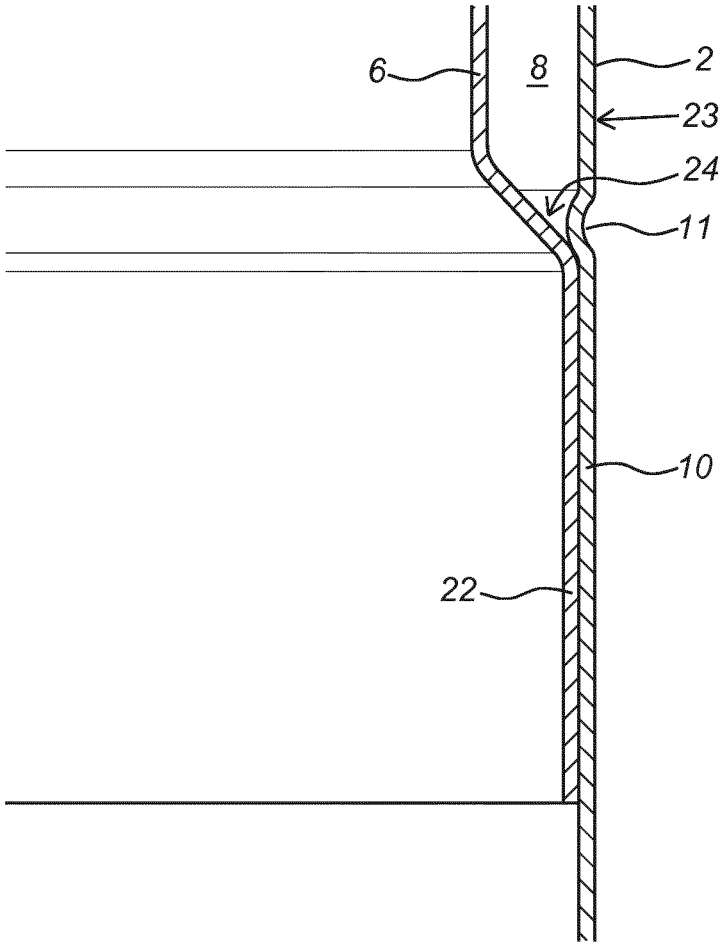
Figure 3:
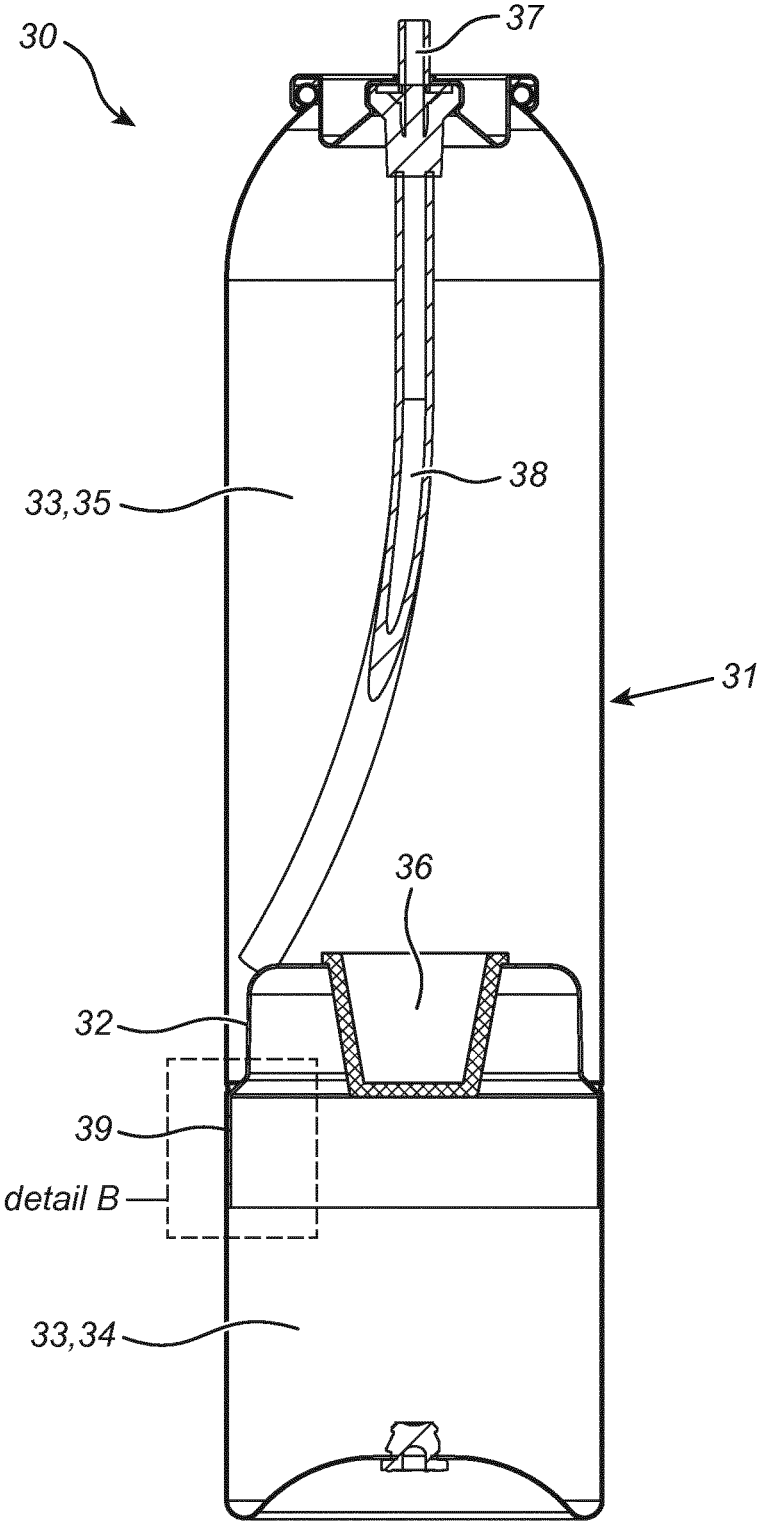
Figure 4:
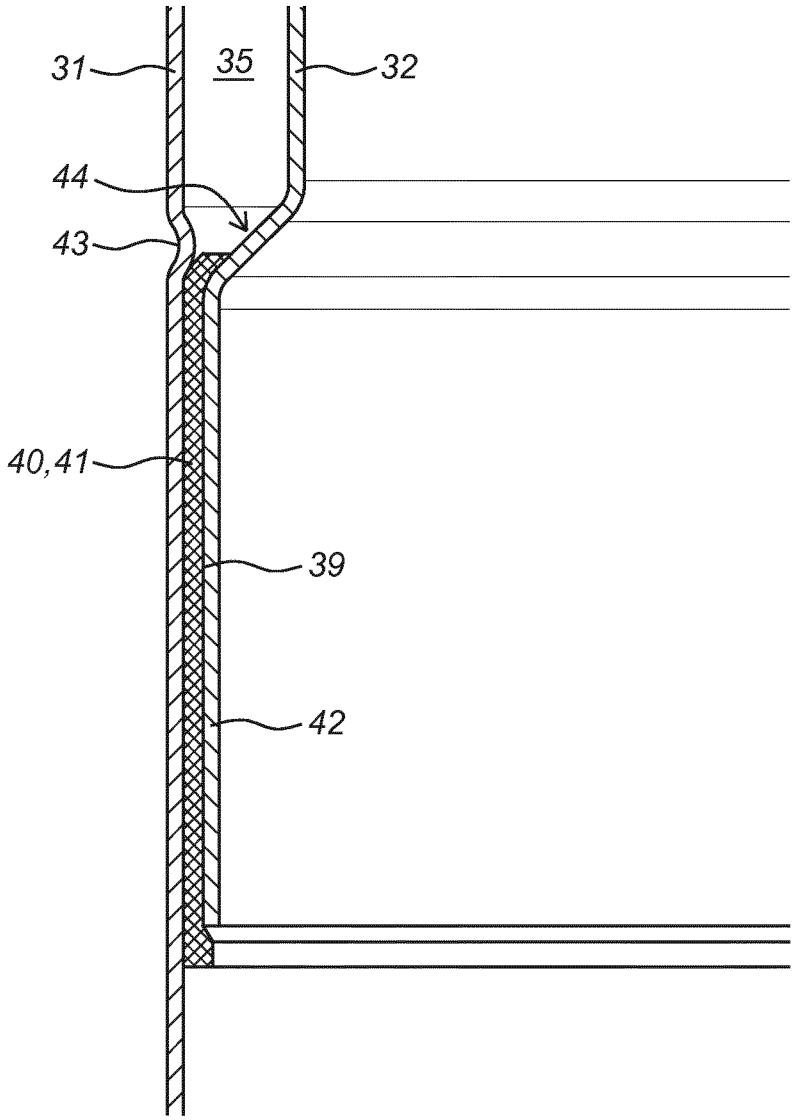
Figure 5:
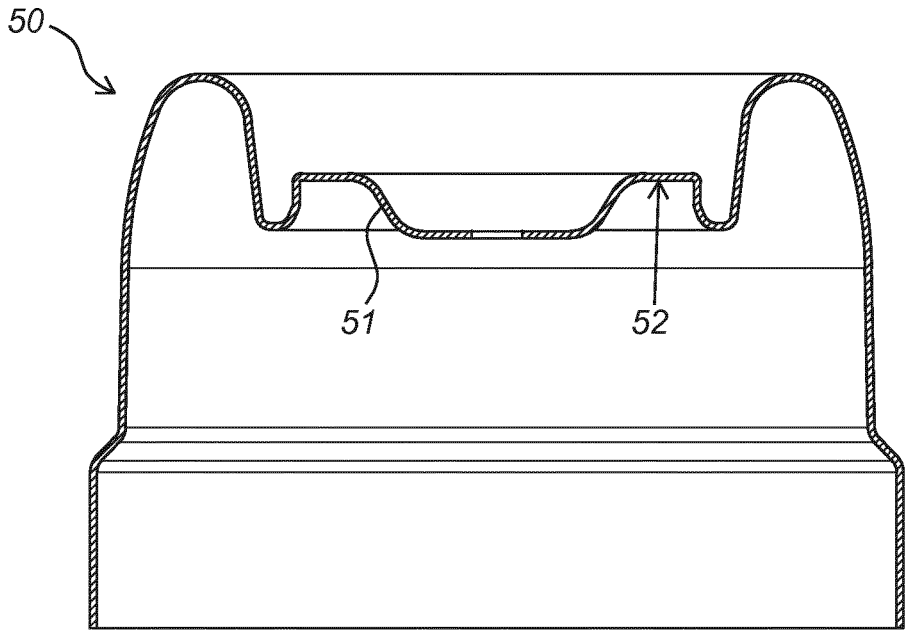

The invention will now be elucidated on the basis of non-limitative exemplary embodiments which are illustrated in the following figures. Corresponding elements are denoted in the figures by corresponding reference numbers. In the figures:

FIG. 1 shows a longitudinal cross-section of a first embodiment of a dispenser container according to the invention, FIG. 2 shows an up close view on "detail A" of the dispenser container as shown in FIG. 1, FIG. 3 shows a longitudinal cross-section of a second embodiment of a dispenser container according to the invention, FIG. 4 shows an up close view on "detail B" of the dispenser container as shown in FIG. 3, and FIG. 5 shows a longitudinal cross-section of a partition wall for use in a dispenser container according to the invention.

FIG. 1 shows a longitudinal cross-section of a first embodiment of a dispenser container 1 according to the invention. The dispenser container (1) comprises an outer wall formed by a metal shell (2) comprising a side wall (3) and a bottom (4). In the depicted case, the side wall (3) and the bottom (4) form a single, integral part of the metal shell (2). However, it is likewise possible that metal shell (2) comprises a seamed side wall (3) and a separate bottom (4), connected to the side wall (3) by means of another seam. The metal shell (2) encloses an internal container volume (5) which is, with the interposition of a partition wall (6), divided into a high-pressure chamber (7) and a low-pressure chamber (8). The high-pressure chamber (7) functions as a reservoir for a (highly) compressed propellant (9), which resides in the high-pressure chamber (7), possibly in a (partially) liquid form. Suitable propellants (9) include propane, butane, carbon dioxide, nitrogen, air or any other suitable substance. Preferably, a propellant is chosen that does not chemically react with the dispensable fluid. The high-pressure chamber (7) is delimited partly by the partition wall (6) and partly by the metal shell (2). The partition wall (6) is hereby at a sealing zone (10) sealed to the metal shell (2) in a substantially fluid-tight manner such that a (highly) pressurized propellant (9) is contained inside the high-pressure chamber (7). As a way of obtaining this fluid-tight seal, the partition wall (6) is fixedly connected to the metal shell (2) in a form-fitting manner, wherein the part of the partition wall (6) connected to the metal shell (2) follows the contours of the metal shell. Specifically, the partition wall (6) hereby lies against an indent (11) provided in the container outer wall, as is shown in more detail in FIG. 2. The partition wall (6) moreover comprises a rim portion (22) extending in a direction parallel to the metal shell (2), wherein the rim portion (22) (partly) forms part of the sealing zone (10). To allow for a controlled release of propellant (9) from the high-pressure chamber (7) to the low-pressure chamber (8), a valve (12) is mounted into the partition wall (6) in a substantially fluid-tight manner. In the presently shown embodiment, said valve (12) is a constant pressure release valve configured for releasing propellant (9) from the high pressure chamber (7) to the low pressure chamber (8) at a constant pressure. The metal shell (2) is at the bottom (4) thereof provided with another valve, being a dedicated filling valve (13) that connects to the high-pressure chamber (7). The low-pressure chamber (8) is, like the high-pressure chamber (7), delimited partly by the partition wall (6) and partly by the metal shell (2). The low-pressure chamber (8) is configured to contain a dispensable fluid (14) as well as the pressurized propellant (9), both held under a lower pressure than the propellant (9) present in the high-pressure chamber (7). On a neck portion (15) of the metal shell (2) at the top end of the dispenser container (1) an outlet valve (16) is positioned through which the dispensable fluid (14) present in the low-pressure chamber (8) may be dispensed. The outlet valve (16) hereto connects the low-pressure chamber (8) with an outside of the dispenser container (1). A piston (17), moveably positioned in the low-pressure chamber (8), separates the low-pressure chamber (8) into a first compartment (18) and a second compartment (19). The first compartment (18), extending between the partition wall (6) and the piston (17), hereby contains the propellant (9) originating from the high-pressure chamber (7), while the second compartment (19), extending between the piston (17) and the outlet valve (16), contains the fluid (14) to be dispensed. In the depicted embodiment, the piston (17) connects to internal wall of the metal shell (2) in a substantially fluid-tight manner, such that even a low viscosity dispensable liquid (14) remains separated from the propellant (9). During use of the dispenser, the piston (17) typically moves from a first position wherein in lies against the partition wall (6) to a second position wherein it lies against the neck portion (15) of the dispenser container (1). In the first position, the second compartment (19) is at its maximum volume such that the low-pressure chamber (8) is substantially completely filled with dispensable fluid (14). In the second position, the second compartment (8) is at its minimum volume such that the low-pressure chamber (8) is substantially completely emptied of dispensable fluid (14). To ensure that a minimum amount of dispensable fluid (14) remains inside the second compartment (8) when the dispenser is emptied, the surface (20) of the piston (17) facing the outlet valve (16) is given a shape corresponding to the contours of bottom end (21) of the outlet valve (16) facing the piston (17) such that the piston (17) lies flat against the outlet valve (16) and the volume of the second compartment (8) is effectively reduced to zero.

FIG. 2 shows an up close view on "detail A" of the dispenser container (1) as shown in FIG. 1. This details shows the connection of the partition wall (6) to the metal shell (2) forming an outer wall of the dispenser container (1). It can be seen that the outer side (23) of the metal shell (2) is provided with an indent (11) extending into the internal container volume (5), and in particular into the low-pressure chamber (8). This indent (11) constitutes part of the sealing zone (10) and forms an abutment surface for a part of a surface (24) of the partition wall (6) adjoining the low-pressure chamber (8). Also part of the sealing zone is the rim portion (22) of the partition wall (6) that extends in a direction parallel to the metal shell (2). It is hereby possible that the partition wall (6) extends all the way up to the bottom (4) of the metal shell (2) to effectively increase the area over which the partition wall (6) can be connected to the metal shell (2). The indent (11) typically extends fully around a circumference of the outer wall of the dispenser container (1) to maximally benefit the quality of the seal between the metal shell (2) and the partition wall (6).

FIG. 3 shows a longitudinal cross-section of a second embodiment of a dispenser container (30) according to the invention. Like the dispenser container (1) shown in FIG. 1, this dispenser container (30) comprises a metal shell (31), on an inside provided with a partition wall (32) sealed to the metal shell (31) to separate the internal container volume (33) into a high-pressure chamber (34) and a low-pressure chamber (35). The partition wall (32) is again provided with a (constant pressure release) valve (36) and the top end of the dispenser container (30) is provided with an outlet valve (37). This time however, the low-pressure chamber (8) does not house a piston. Instead thereof, a dip tube (38) is connected to the outlet valve (37) and extends into the low-pressure chamber (35) up to the partition wall (32). It is however also conceivable that the a dip tube (38) is used in combination with a piston, wherein the dip tube (38) only extends into the then created second compartment of the low-pressure chamber (35). Another difference is related to the sealing zone (39) and concerns the way in which the partition wall (32) is sealed to the metal shell (31), which difference is further elaborated upon with regard to FIG. 4.

FIG. 4 shows an up close view on "detail B" of the dispenser container (30) as shown in FIG. 3. As can be seen, a sealing material (40) is provided at the sealing zone (39) between the metal shell (31) and the partition wall (32) in the form of a ring (41) being pre-assembled around at least a part of a rim portion (42) of the partition wall (32). The ring (41) is typically (partly) melted to create the seal between the partition wall (32) and the metal shell (31). An indent (43) again constitutes part of the sealing zone (39) and forms an abutment surface for a part of a surface (44) of the partition wall (32) adjoining the low-pressure chamber (35), wherein the sealing material (40) interposes the partition wall (32) and said indent (43).

FIG. 5 shows a longitudinal cross-section of a partition wall (50) for use in a dispenser container (1, 30) according to the invention. Other than the partition walls (6, 32) of the dispenser containers shown in FIGS. 1 and 3, this partition wall (50) comprises a profiled wall part (51) configured for supporting, with a surface (52) facing the high-pressure chamber, a part (and preferably a circumferential part) of the top surface of a (constant pressure release) valve (12, 36) as shown in FIGS. 1 and 2. As the valve (12, 36) is pressed against the partition wall (50) under the influence of the overpressure in the high-pressure chamber (7, 34), a seal is then automatically created between the partition wall (50) and the valve (12, 36).

It should be clear that the invention is not limited to the exemplary embodiments illustrated and described here, but that countless variants are possible within the framework of the attached claims which will be obvious to the person skilled in the art. It is therefore conceivable for various inventive concepts and/or technical measures of the above-described variant embodiments to be completely or partly combined without, in this case, moving away from the inventive idea described in the attached claims. The differences in the way in which the partition wall is sealed to the metal shell as shown in FIGS. 2 and 4 between the embodiments of the dispenser container according to the invention as shown in FIGS. 1 and 3 are for example not dependent on other embodiment specific differences.

The dispenser container according to the present invention may also be characterized in that the metal shell comprises a side wall and a bottom. The side wall and the bottom may form a single, integral part of the metal shell. A further option is that the metal shell comprises a seamed side wall and a separate bottom, connected to the side wall.

The valve may be a constant pressure release valve configured for releasing fluid from the high pressure chamber to the low pressure chamber at a constant pressure and/or the valve may be configured as a filling valve allowing the pass-through of a fluid to the high-pressure chamber. Also the metal shell may be provided with a dedicated filling valve connecting to the high-pressure chamber.

The dispenser container may comprises a piston moveably positioned in the low-pressure chamber, wherein the piston separates the low-pressure chamber into: a first compartment extending between the partition wall and the piston, and a second compartment bordering a side of the piston facing away from the first compartment. In a bottommost position of the piston of such a dispenser container, wherein the piston at least partly abuts the partition wall, a space may be left between the piston and the partition wall, wherein said space has a volume of at least 4 ml.

The dispenser container may also comprise an outlet valve connecting the low-pressure chamber with an outside of the dispenser container, and optionally the dispenser container may also comprise a dip tube that is connected to the outlet valve and extends into the low-pressure chamber.

A surface of the piston facing the second compartment may have a shape at least partly corresponding to the contours of bottom end of the outlet valve facing the piston and/or the high-pressure chamber may contain a propellant and the low pressure chamber may comprise a fluid to be dispensed.

The method for manufacturing a dispenser container may be characterized in that step A) comprises deep drawing a blank wherein a punch is driven into the blank, thus forming a single, integral part comprising a bottom and a side wall of the metal shell. As an alternative step A) may comprise transforming a metal sheet into a tubular side wall wherein two adjacent edges of the metal sheet are connected with a seam, and subsequently connecting a separate bottom to a bottom end of the tubular side wall. Step D) of the method for manufacturing a dispenser container may involve locally heating the metal shell and/or the partition wall at the sealing zone, which local heating of the metal shell and/or the partition wall at the sealing zone may be performed through electromagnetic induction.

During the manufacturing of a dispenser container the sealing zone may be actively cooled after sealing of the partition wall to the metal shell.

It is also an option that after step D) a top end of the metal shell opposing a bottom of the metal shell is formed into a neck portion configured for connection with an outlet valve. And the low-pressure chamber may be filled through the neck portion with a fluid to be dispensed, after which an outlet valve is connected to the neck portion.

The invention claimed is:

1. A dispenser container for pressurized fluids, comprising:

a metal shell forming at least part of an outer wall of the dispenser container, wherein said metal shell at least partly encloses an internal container volume;

a partition wall separating the internal container volume into a high-pressure chamber and a low-pressure chamber; and a valve mounted into the partition wall in a substantially fluid-tight manner, wherein said valve is configured for a controlled release of fluid from the high-pressure chamber to the low-pressure chamber, wherein the partition wall is at a sealing zone sealed to the metal shell in a substantially fluid-tight manner, wherein the metal shell delimits at least a part of the high-pressure chamber, and wherein an outer side of the metal shell is provided with at least one indent extending into the internal container volume, wherein the at least one indent forms at least part of the sealing zone such that applying a pressure difference over the partition wall causes the partition wall to press against said at least one indent extending into the internal container volume to seal the partition wall to the metal shell.

2. A dispenser container for pressurized fluids, comprising:

a metal shell forming at least part of an outer wall of the dispenser container, wherein said metal shell at least partly encloses an internal container volume;

a partition wall separating the internal container volume into a high-pressure chamber and a low-pressure chamber; and a valve mounted into the partition wall in a substantially fluid-tight manner, wherein said valve is configured for a controlled release of fluid from the high-pressure chamber to the low-pressure chamber, wherein the partition wall is at a sealing zone sealed to the metal shell in a substantially fluid-tight manner, wherein the metal shell delimits at least a part of the high-pressure chamber, and wherein an outer side of the metal shell is provided with at least one indent extending into the internal container volume, wherein the at least one indent forms at least part of the sealing zone.

3. The dispenser container according to claim 2, characterized in that the metal shell delimits at least a part of the low-pressure chamber.

4. The dispenser container according to claim 2, characterized in that the partition wall is fixedly connected to the metal shell.

5. The dispenser container according to claim 2, characterized in that the at least one indent extends at least partly along the container.

6. The dispenser container according to claim 2, characterized in that the at least one indent extends into the low-pressure chamber and forms an abutment surface for a part of a surface of the partition wall adjoining the low-pressure chamber.

7. The dispenser container according to claim 2, characterized in that the partition wall has an at least partly convex shape, extending at least partly past the sealing zone into the low-pressure chamber.

8. The dispenser container according to claim 7, characterized in that the partition wall comprises a rim portion extending in a direction parallel to the metal shell, wherein at least part of the rim portion forms part of the sealing zone.

9. The dispenser container according to claim 2, characterized in that the partition wall has an at least partly concave shape, extending at least partly past the sealing zone into the high-pressure chamber.

10. A method for manufacturing a dispenser container according to claim 2, comprising the steps of:

A) forming the metal shell;

B) mounting the valve into the partition wall;

C) positioning the partition wall into the internal container volume at least partly enclosed by the metal shell;

D) applying a pressure difference over the partition wall such that the partition wall is pressed against the at least one indent extending into the internal container volume; and E) sealing the partition wall to the metal shell.

11. The method according to claim 10, characterized in that the at least one indent extends into the internal container volume at a side of the partition wall adjoining the low-pressure chamber, and in that, as a result of the applied pressure difference, the pressure at a side of the partition wall adjoining the high-pressure chamber exceeds the pressure at the side of the partition wall adjoining the low-pressure chamber such that the partition wall is pressed against the indent with a part of a surface of the partition wall adjoining the low-pressure chamber.

12. The method according to any of the claim 10, characterized in that the partition wall is sealed to the metal shell by means of at least one of a welded bond, a soldered bond, an adhesive bond, a fusion bond, a friction bond and a gasket.

13. The method according to claim 12, characterized in that the partition wall is sealed to the metal shell by at least partly melting a sealing material provided at the sealing zone between the metal shell and the partition wall.

14. The method according to claim 13, characterized in that prior to step C) the sealing material is applied onto the partition wall.

15. The method according to claim 13, characterized in that prior to step C) the sealing material is applied onto the partition wall in the form of a ring being pre-assembled around at least a part of a rim portion of the partition wall.

16. The dispenser container according to claim 2, characterized in that the at least one indent extends at fully around a circumference of the outer wall of the container.

* * * * *